US008794163B1

(12) United States Patent
Shokouhi

(10) Patent No.: US 8,794,163 B1
(45) Date of Patent: Aug. 5, 2014

(54) MODULAR STACKABLE TABLE SYSTEMS

(71) Applicant: Chameleon Chairs LLC, Torrance, CA (US)

(72) Inventor: Behshad Shokouhi, Sherman Oaks, CA (US)

(73) Assignee: Chameleon Chairs LLC, Torrance, CA (US)

( * ) Notice: Subject to any disclaimer, the term of this patent is extended or adjusted under 35 U.S.C. 154(b) by 0 days.

(21) Appl. No.: 13/747,622

(22) Filed: Jan. 23, 2013

Related U.S. Application Data

(60) Provisional application No. 61/644,361, filed on May 8, 2012, provisional application No. 61/590,666, filed on Jan. 25, 2012.

(51) Int. Cl.
*A47B 7/00* (2006.01)

(52) U.S. Cl.
USPC ..... 108/91

(58) Field of Classification Search
USPC ..... 108/91, 150, 27, 157.19, 159, 157.17, 108/157.1, 157.18, 93, 90, 64, 92
See application file for complete search history.

(56) References Cited

U.S. PATENT DOCUMENTS

| | | | | | |
|---|---|---|---|---|---|
| D153,909 | S | * | 5/1949 | Wais | D6/483 |
| 2,833,607 | A | * | 5/1958 | Mackintosh | 108/91 |
| 3,100,459 | A | * | 8/1963 | Liss et al. | 108/91 |
| 3,366,079 | A | * | 1/1968 | Koransky et al. | 108/157.15 |
| 3,643,608 | A | * | 2/1972 | DeCesaris | 108/153.1 |
| 4,003,320 | A | * | 1/1977 | Owens et al. | 108/158 |
| 4,092,042 | A | * | 5/1978 | Cusenbary | 108/157.1 |
| 4,700,915 | A | * | 10/1987 | Killian | 108/150 |
| 4,779,541 | A | * | 10/1988 | Milward | 108/91 |
| 4,805,541 | A | * | 2/1989 | Drane et al. | 108/27 |
| 4,823,709 | A | * | 4/1989 | Tesney | 108/157.15 |
| 4,905,612 | A | * | 3/1990 | Apissomian | 108/157.15 |
| 4,941,413 | A | * | 7/1990 | Vanderminden | 108/157.15 |
| 5,791,264 | A | * | 8/1998 | McCraney | 108/151 |
| 5,794,545 | A | | 8/1998 | McDaniel et al. | |
| 6,006,679 | A | * | 12/1999 | Lin | 108/157.15 |
| D668,478 | S | * | 10/2012 | Shokouhi | D6/488 |

* cited by examiner

*Primary Examiner* — Jose V Chen
(74) *Attorney, Agent, or Firm* — Stoneman Law Patent Group; Martin L. Stoneman; David A. Spellman

(57) ABSTRACT

A modular stackable table system providing stackable bar tables that may be selectively customized by interchanging of the base supports and tops.

21 Claims, 10 Drawing Sheets

MODULAR STACKABLE TABLE SYSTEMS

CROSS-REFERENCE TO RELATED APPLICATION

The present application is related to and claims priority from prior provisional application Ser. No. 61/644,361, filed May 8, 2012, entitled "MODULAR STACKING TABLE SYSTEMS"; and, this application is related to and claims priority from prior provisional application Ser. No. 61/590,666, filed Jan. 25, 2012, entitled "MODULAR STACKING TABLE SYSTEMS", the contents of all of which are incorporated herein by this reference and are not admitted to be prior art with respect to the present invention by the mention in this cross-reference section.

BACKGROUND

This invention relates to providing a modular stackable table system. More particularly, this invention relates to providing a system of stackable bar tables that may be selectively customized by interchanging of the base supports and tops.

No system exists that permits furniture renters to fill diverse customer orders from a small stock of modular table components and tops. No commercial rental tables exist that can be easily, inexpensively, and modularly repaired, updated, stored, and transported. Therefore, a need exists for a modular stackable furniture system that permits furniture renters to fill diverse customer orders from a small stock of modular components. Further, a need exists for commercial rental tables that can be easily, inexpensively, and modularly repaired, updated, stored, and transported.

OBJECTS AND FEATURES OF THE INVENTION

A primary object and feature of the present invention is to provide a system overcoming the above-mentioned problem(s).

It is a further object and feature of the present invention to provide such a system comprised of stackable bar tables that may be selectively customized by interchanging of the base supports and tops.

A further primary object and feature of the present invention is to provide such a system that is efficient, inexpensive, and handy. Other objects and features of this invention will become apparent with reference to the following descriptions.

SUMMARY OF THE INVENTION

In accordance with a preferred embodiment hereof, this invention provides a modular table system relating to modular table components capable of forming distinct sets of themed tables, such modular table system comprising: at least one first set of table bases, each such table base of such at least one first set of table bases comprising at least one first common base feature; at least one first set of table tops, each such table top of such at least one first set of table tops comprising at least one first common top feature; and at least one second set of table tops, each such table top of such at least one second set of table tops comprising at least one second common top feature differing from such at least one first common top feature; wherein each table top of such at least one first set of table tops and such at least one second set of table tops is configured to be supportable by each such table base of such at least one first set of table bases; wherein each such table top of such at least one first set of table tops and each such table top of such at least one second set of table tops comprise at least one receiver structured and arranged to receive at least one engaging portion of at least one such table base of such at least one first set of table bases; wherein each such table base of such at least one first set of table bases comprises such at least one engaging portion structured and arranged to engage such at least one receiver of each such table top of either one of such at least one first set of table tops and such at least one second set of table tops; wherein each such at least one receiver and such at least one engaging portion together comprise at least one frictional retainer structured and arranged to assist frictional retention of such at least one engaging portion with such at least one receiver; wherein such at least one frictional retainer comprises at least on pressure-modulated force increaser structured and arranged to provide increasing levels of friction force between such at least one receiver and such at least one engaging portion as weight supported by a respective one of such table top is increased; and wherein, when detached from such table top, each such table base of such at least one first set of table bases nesting-stacking with each other such table base of such at least one first set of table bases.

Moreover, it provides such a modular table system further comprising: at least one second set of table bases, each such table base of such at least one second set of table bases comprising at least one second common base feature differing from such at least one first common base feature; wherein each table top of such at least one first set of table tops and such at least one second set of table tops is configured to be supportable by each such table base of either one of such at least one first set of table bases and each such table base of such at least one second set of table bases; wherein each such table top of such at least one first set of table tops and each such table top of such at least one second set of table tops comprise at least one receiver structured and arranged to receive at least one engaging portion of at least one such table base of either one of such at least one first set of table bases and such at least one second set of table bases; wherein each such table base of such at least one first set of table bases and each such table base of such at least one second set of table bases comprise such at least one engaging portion structured and arranged to engage such at least one receiver of each such table top of either one of such at least one first set of table tops and such at least one second set of table tops; and wherein, when detached from such table top, each such table base of such at least one first set of table bases allow nesting-stacking with each such table base of either such at least one second set of table bases and such at least one second set of table bases.

Additionally, it provides such a modular table system wherein each such table base comprises: at least three support legs that together comprise at least one lower table-base portion and at least one upper table-base portion; and at least one table-base height extending substantially vertically between such at least one lower table-base portion and such at least one upper table-base portion; wherein such at least one lower table-base portion is configured to rest stably on at least one supportive surface; and wherein such at least one upper table-base portion comprises such at least one engaging portion. Also, it provides such a modular table system further comprising: at least one leg connector structured and arranged to rigidly interconnect such at least three support legs; wherein such at least one leg connector is located at or below a mid-point height of such table base equaling about one half of such at least one table-base height.

In addition, it provides such a modular table system wherein: within such at least one upper table-base portion, each such at least three support legs comprise at least one upper termination; and each such at least three support legs project generally upwardly and outwardly as such at least three support legs approach their respective such at least one upper terminations. And, it provides such a modular table system wherein each one of such at least three support legs follows a continuous curve. Further, it provides such a modular table system wherein each respective such at least one upper termination of such at least three support legs comprise a respective such at least one engaging portion.

Even further, it provides such a modular table system further comprising four of such at least three support legs spaced equidistantly about a vertical central axis. Moreover, it provides such a modular table system wherein: such table top is constructed substantially of at least one medium density fiberboard; and each such table base is constructed substantially of at least one rigid metallic material. Additionally, it provides such a modular table system wherein such at least one rigid metallic material comprises substantially steel. Also, it provides such a modular table system wherein: such table-base height comprises a maximum height of about 110 centimeters; and such table top comprises a maximum width of about 100 centimeters.

In addition, it provides such a modular table system wherein such at least one lower table-base portion comprises a maximum contact width of about 60 centimeters. And, it provides such a modular table system wherein at least one such table top and at least one such table base are configured to support, in an operable position, at least one shaft of at least one umbrella. Further, it provides such a modular table system wherein: each such table top comprises at least one upper surface and at least one lower surface; such at least one lower surface comprises such at least one receiver; such at least one upper surface comprises at least one texture-providing groove recessed below such at least one upper surface.

In accordance with another preferred embodiment hereof, this invention provides a method relating to forming distinct sets of themed tables from modular table components, such method comprising the steps of: providing at least one set of modular table bases comprising multiple table-base themes; providing at least one set of modular table tops comprising multiple table-top themes; configuring each table top of such at least one set of modular table tops to be supportable by each such table base of such at least one set of modular table bases; configuring each table top of such at least one set of modular table tops to comprise at least one receiver structured and arranged to receive at least one engaging portion of at least one such table base; configuring each such table base of such at least one set of modular table bases to comprise such at least one engaging portion structured and arranged to engage such at least one receiver of each such table top; wherein each such at least one receiver and such at least one engaging portion together comprise at least one frictional retainer structured and arranged to assist frictional retention of such at least one engaging portion with such at least one receiver; wherein such at least one frictional retainer comprises at least on pressure-modulated force increaser structured and arranged to provide increasing levels of friction force between such at least one receiver and such at least one engaging portion as weight supported by a respective one of such table top is increased; and wherein at least one distinct set of tables, comprising a distinct table theme, may be developed by combining such table tops selected from such at least one set of modular table tops with such at least one table bases selected from such at least one set of modular table bases. Even further, it provides such a method further comprising the step of configuring such table bases to allow for compact nesting-stacking of a plurality of such table bases when such table bases are detached from such table tops.

In accordance with another preferred embodiment hereof, this invention provides a modular table system relating to modular table components capable of forming distinct sets of themed tables, such modular table system comprising: at least one set of modular table bases comprising multiple table-base themes; at least one set of modular table tops comprising multiple table-top themes; wherein each table top of such at least one set of modular table tops is configured to be supportable by each such table base of such at least one set of modular table bases; wherein each such table base comprises at least three support legs that together comprise at least one lower table-base portion and at least one upper table-base portion, at least one table-base height extending substantially vertically between such at least one lower table-base portion and such at least one upper table-base portion, and at least one leg connector structured and arranged to rigidly interconnect such at least three support legs; wherein such at least one leg connector is located at or below a midpoint of equaling one half of such at least one table-base height; wherein each one of such at least three support legs follow a continuous curve; and wherein at least one distinct set of tables, comprising a distinct table theme, may be developed by combining such table tops selected from such at least one set of modular table tops with such at least one table bases selected from such at least one set of modular table bases. Even further, it provides such a modular table system wherein: such table-base height comprises a maximum height of about 110 centimeters; and such table top comprises a maximum width of about 100 centimeters. Even further, it provides such a modular table system further comprising exactly four of such at least three support legs spaced equidistantly about a vertical central axis. Even further, it provides such a modular table system wherein: such table top is constructed substantially of at least one medium density fiberboard; and each such table base is constructed substantially of at least one rigid metallic material. Even further, it provides such a modular table system wherein such at least one rigid metallic material comprises substantially steel.

According to preferred embodiments of the present invention, this invention provides each and every novel feature, element, combination, step and/or method disclosed or suggested by this patent application.

DETAILED DESCRIPTION OF THE BEST MODES AND PREFERRED EMBODIMENTS OF THE INVENTION

Figure 1:
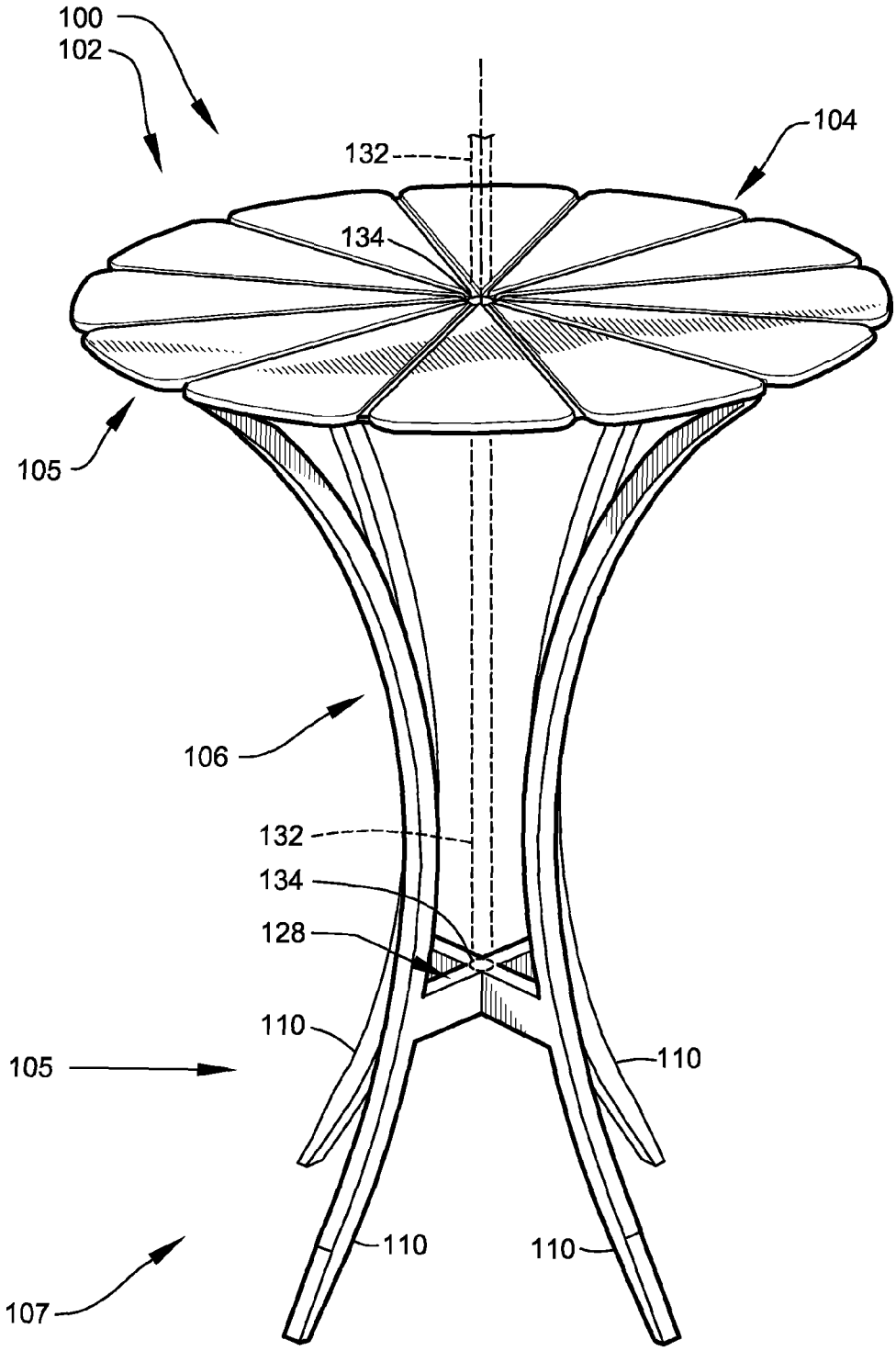
FIG. 1 shows a perspective view illustrating modular stackable table according to a preferred embodiment of the present invention.
Figure 2:
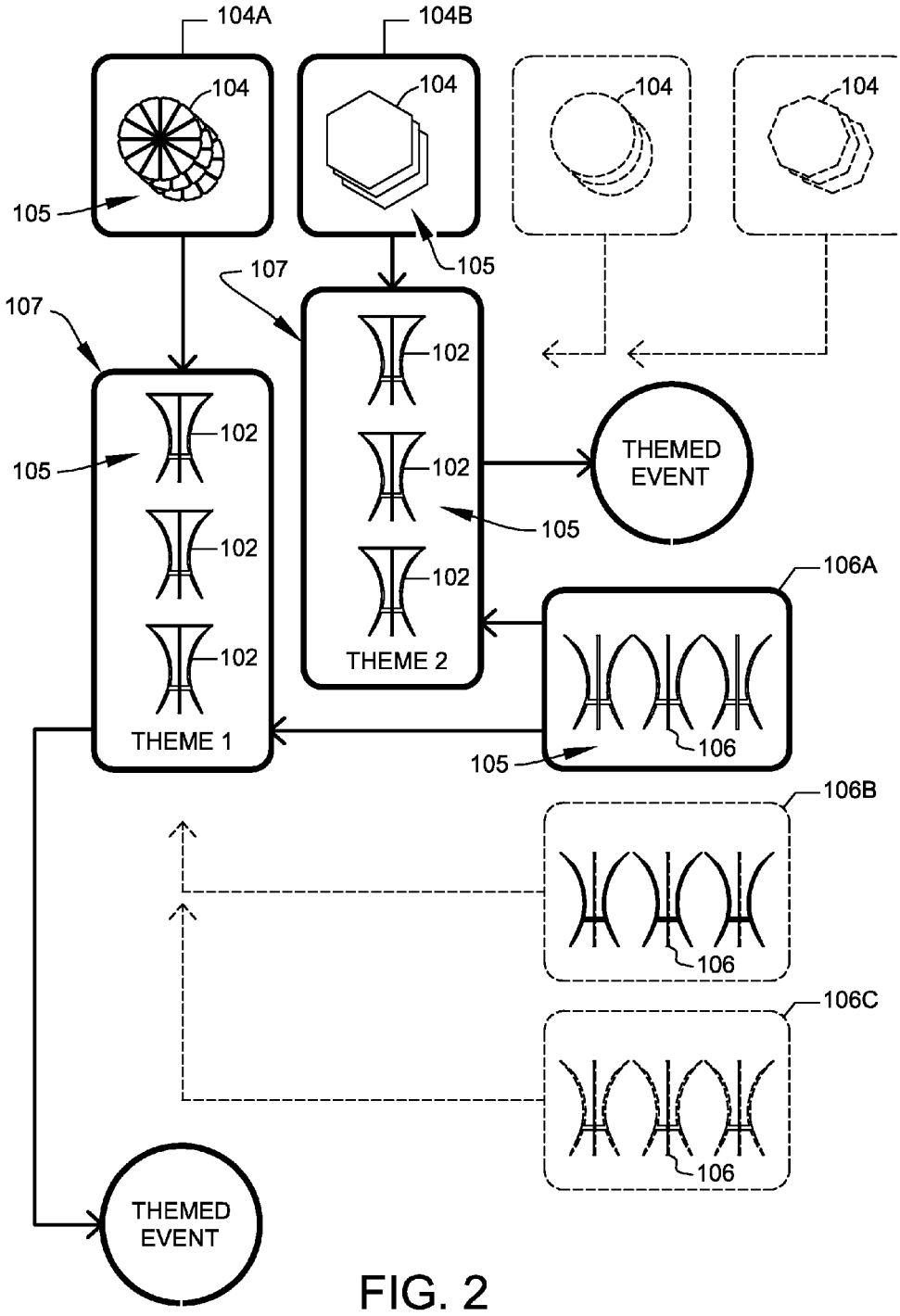
FIG. 2 is a diagram, illustrating sets of distinctly themed tables generated from sets of modular table components, according to preferred methods and embodiments of the present invention.

FIG. 1 shows a perspective view illustrating a modular stackable table 102 according to a preferred embodiment of modular stackable table system 100. FIG. 2 is a diagram, schematically illustrating sets of distinctly themed tables 102 generated from sets of modular table components 105, according to preferred methods and embodiments of the present invention.

Within modular stackable table system 100, multiple distinct sets of "pub-style" table embodiments can be developed by combining selected table bases 106 with selected table tops 104. The resulting tables 102 preferably comprise a common table theme 107; for example, a common table-top shape, a common color theme, a common finish, etc. Preferred themes may also comprise a particular design motif or established style. Examples of possible design motifs or styles that may be developed within the present system include classical/traditional, contemporary, art deco, southwestern, etc. In general, development of such a design motif or style within a modular component is preferably accomplished by the application of appropriate physical detailing associated with such design motif or style, such as, for example, selection of shape and line, component proportions, color selection, surface patterning, ornamentation, etc.

FIG. 2 diagrammatically illustrates how a distinct set of "themed" tables 102 may be generated from sets of pre-existing modular table components 105. The present invention is preferably designed to enable an event-furniture renter to offer, to event customers, numerous distinct table design options, preferably by assembling "themed" tables 102 from a small stock of modular table components 105. Furthermore, it will be described how such small stock of modular table components 105 are preferably adapted to be compactly-stored between uses.

In a representative example illustrating the preferred features of the system, an event-furniture renter stocks at least one first set of table bases 106A, as shown. Alternately preferably, an event-furniture renter stocks both the first set of table bases 106A and one or more second stocks of table bases 106B (106C, etc.), as shown. Each table base 106A of the renter's first set comprises one or more common base features (i.e., a common color, finish, etc.) Each of the renter's second set of table bases 106B also preferably comprise one or more common base features; however, the common base features of table bases 106B preferably differ from the common base features of the first set of table bases 106A.

In a similar manner, the event-furniture renter preferably stocks at least one first set of table tops 104A and at least one second set of table tops 104B, as shown. It should be noted that the renter may elect to acquire as many additional set of tops and/or bases as the renter considers appropriate to meet the needs of their particular markets.

Each table top 104A of the renter's first set comprise one or more common top features (i.e., a common color, finish, shape, etc.) Each of the renter's second set of table tops 104B also preferably comprise one or more common top features; however, the common top features of table tops 104B preferably differ from the common top features of the first set of table tops 104A.

To fill a rental order to provide tables 102 comprising a distinct common table theme 107, the event-furniture renter preferably combines table tops 104 selected from one of the at least two sets of table tops with table bases 106 selected from one of the at least two sets of table bases. All table tops 104A and table tops 104B are preferably configured to be compatible with (that is, supportable by) any selected table bases 106A or table bases 106B of either of the first or second table-base sets.

It should be noted that the system is fully enabled by the event-furniture renter's acquisition of a single uniform stock of table bases 106A; however, acquisition of the second stock of table bases 106B, 106C, etc., comprising a differing appearance from the first set, further enhances the preferred customization options offered by the present system.

Figure 10:
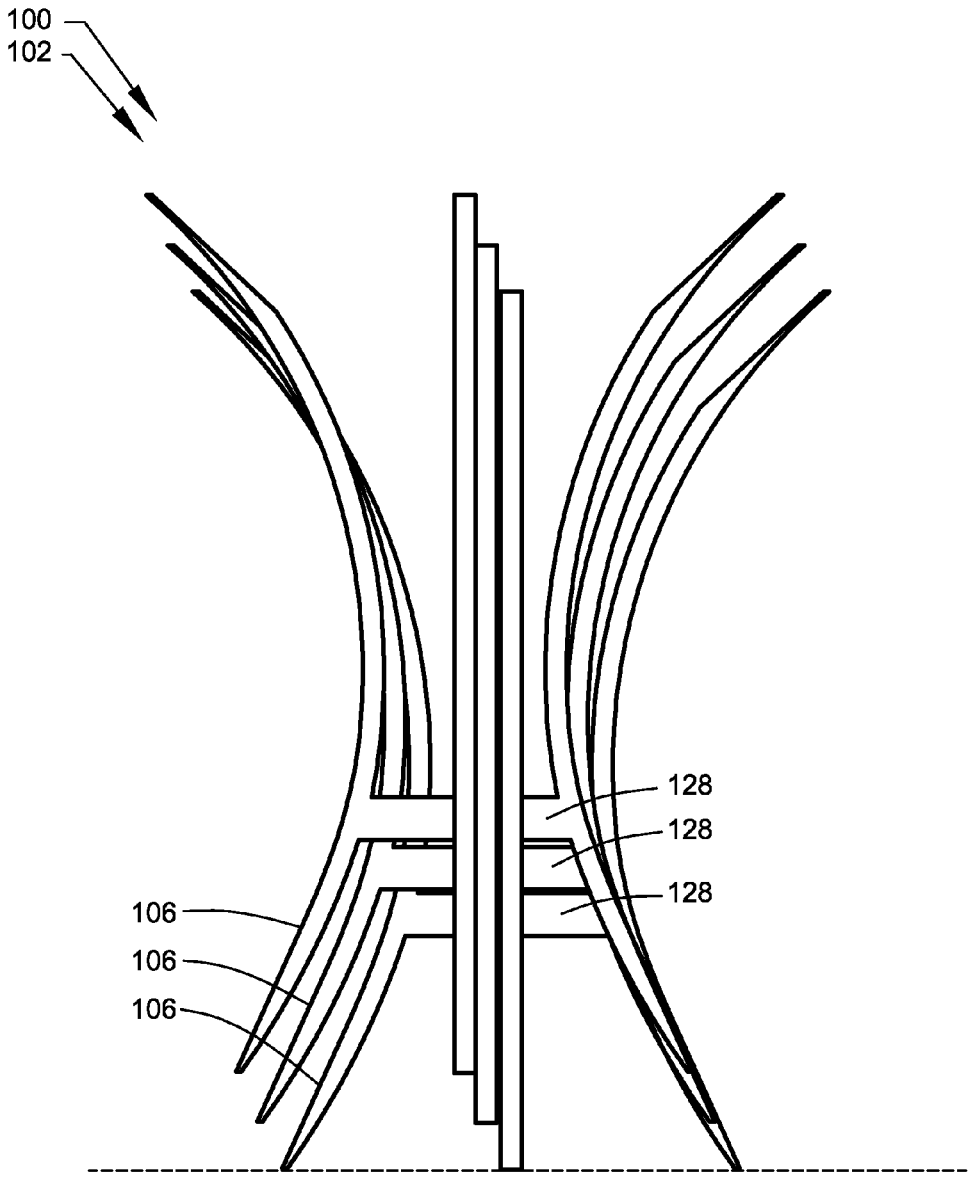
FIG. 10 is a side view of a "nesting-stacked" arrangement of modular stackable tables bases, according to preferred embodiments of the present invention.

When not in use, table bases 106A and table bases 106B of either of the first and second sets of table bases may be nesting-stacked or spirally nesting-stacked, as shown in FIG. 10, and table tops 104 may be stacked separately or otherwise stored. Each stack preferably comprise a minimum of 6 (up to 8) table bases 106. Stacking table bases offers significant benefits in terms of protecting the product, minimizing handling costs, and minimizing storage space requirements. Upon reading this specification, those with ordinary skill in the art will now appreciate that, under appropriate circumstances, considering such issues as design preference, user preferences, marketing preferences, cost, structural requirements, available materials, technological advances, etc., other system arrangements such as, for example, protecting table tops within custom-made sponge covers, storing table tops in slots within a custom-designed transport units, etc., may suffice. Furthermore, those with ordinary skill in the art, upon reading this specification, will now appreciate that, under appropriate circumstances, considering such issues as design preference, user preferences, marketing preferences, cost, structural requirements, available materials, technological advances, etc., other features/arrangements such as, for example, providing such custom-designed transport units, transport dollies, etc., may suffice.

In use, a customer/renter will have a choice of one table base 106 in conjunction with two or more sizes, styles, and geometric configurations of table tops 104. Preferably, table tops 104 will be offered in a range of colors, patterns, and styles, thereby affording customers, especially those in the rental field, the ability to readily coordinate "themed" tables 102 with other design elements/themes of a themed event.

Figure 3:
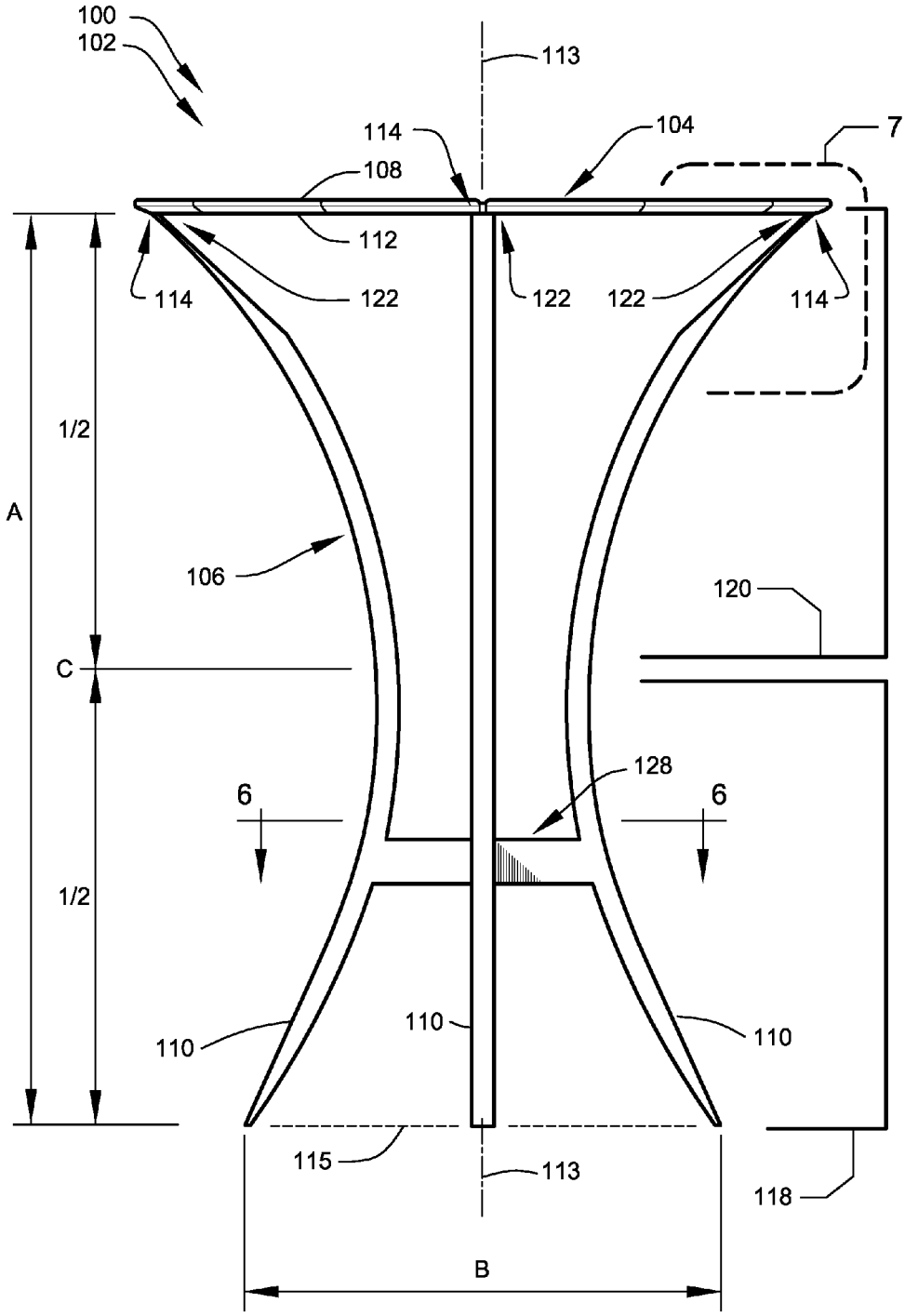
FIG. 3 is a front view of the modular stackable table of FIG. 1, the rear view, the right-side view and the left-side view being symmetrically identical.
Figure 4:
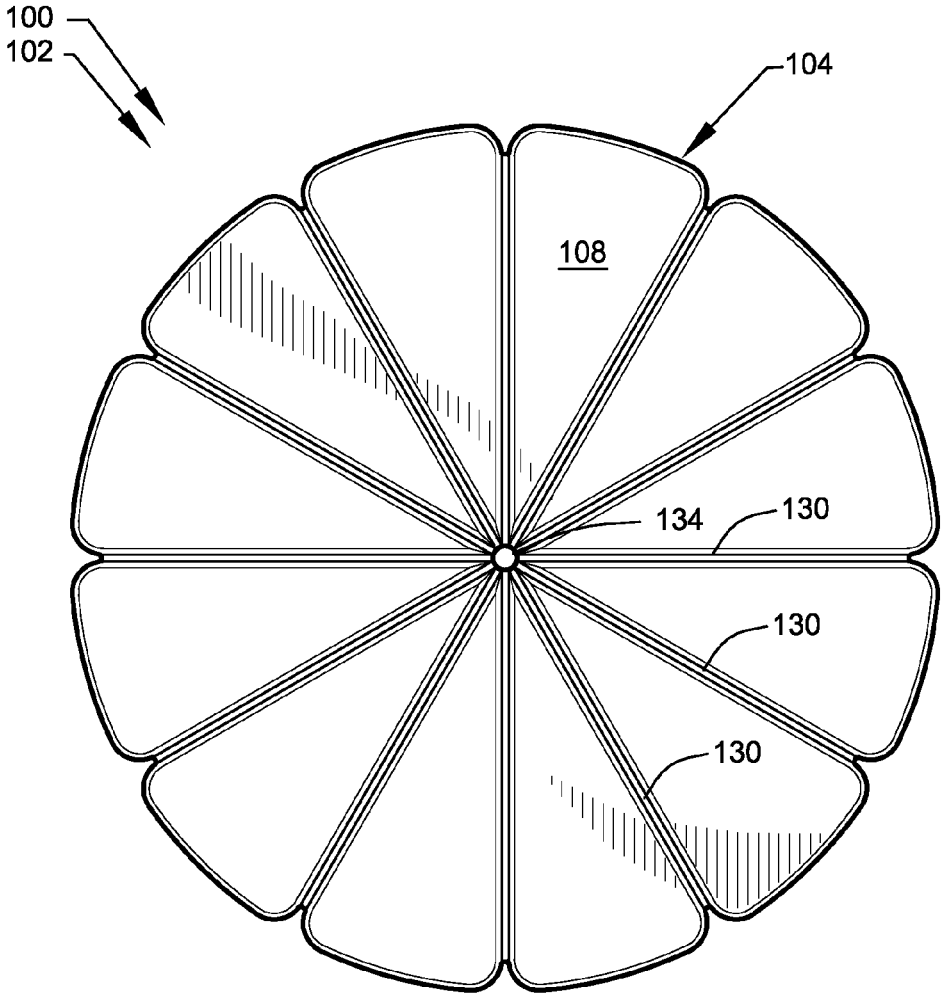
FIG. 4 is a top view modular stackable table of FIG. 1.
Figure 5:
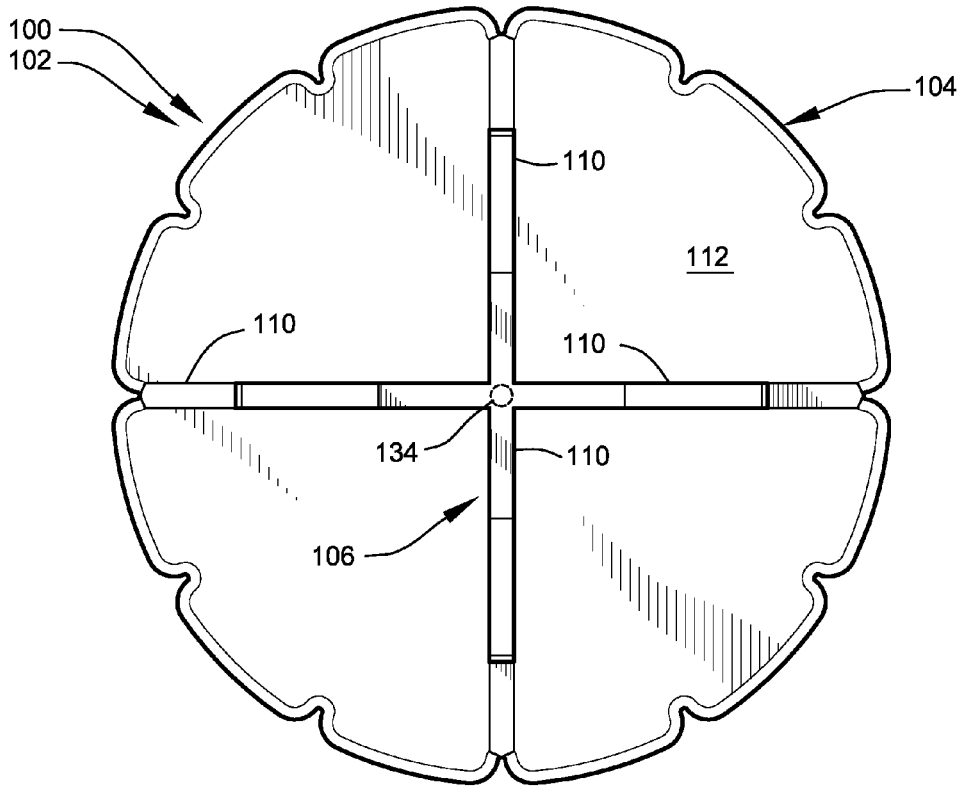
FIG. 5 is a bottom view of the modular stackable table of FIG. 1.
Figure 6:
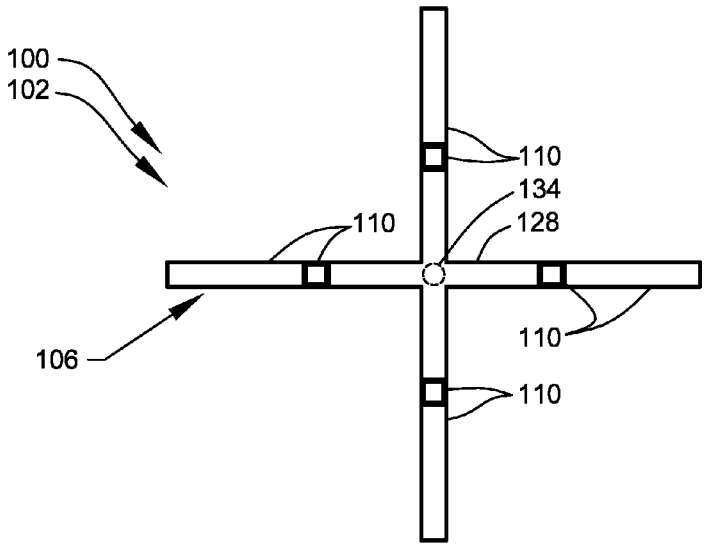
FIG. 6 is a sectional view through the section 6-6 of FIG. 3.
Figure 7:
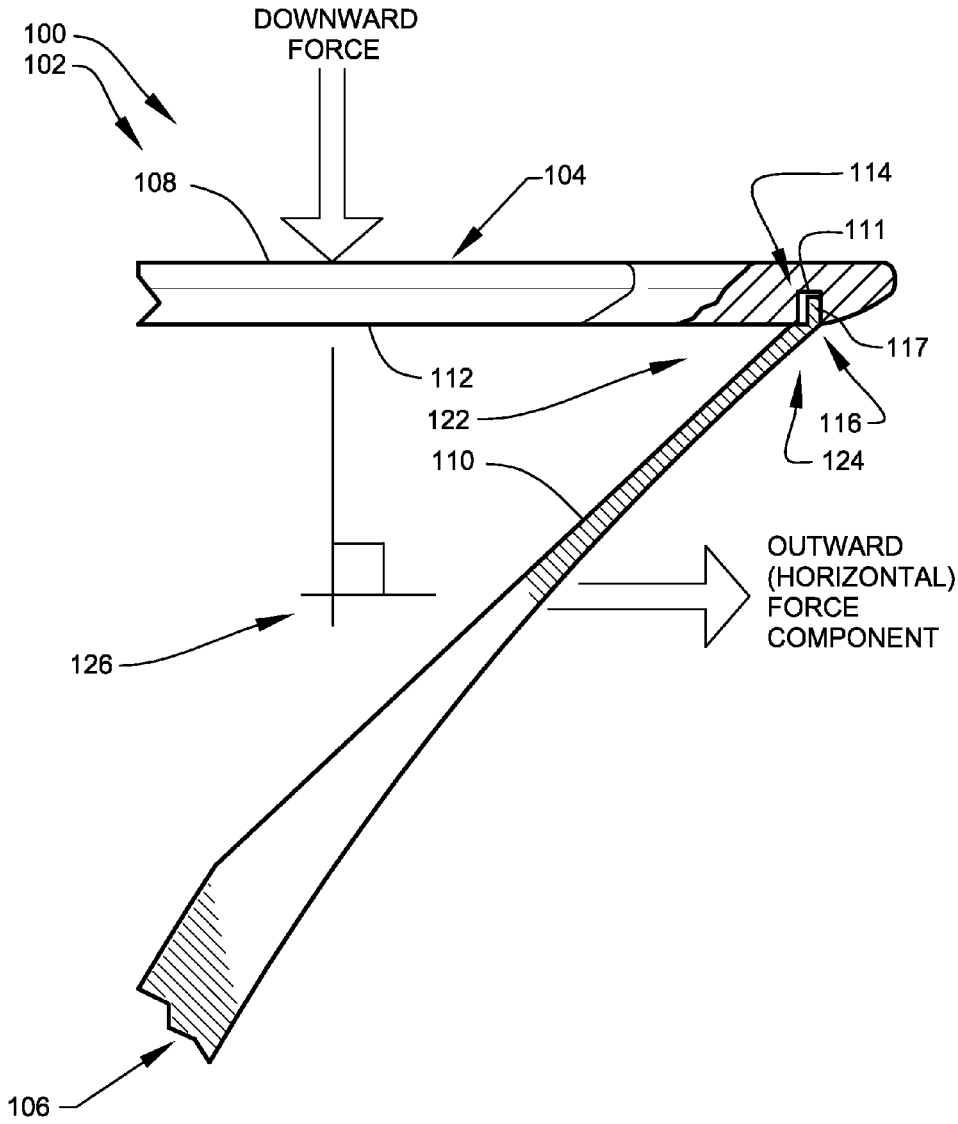
FIG. 7 is a detail view of the detail 7 of FIG. 3 (enlarged for clarity).
Figure 8:
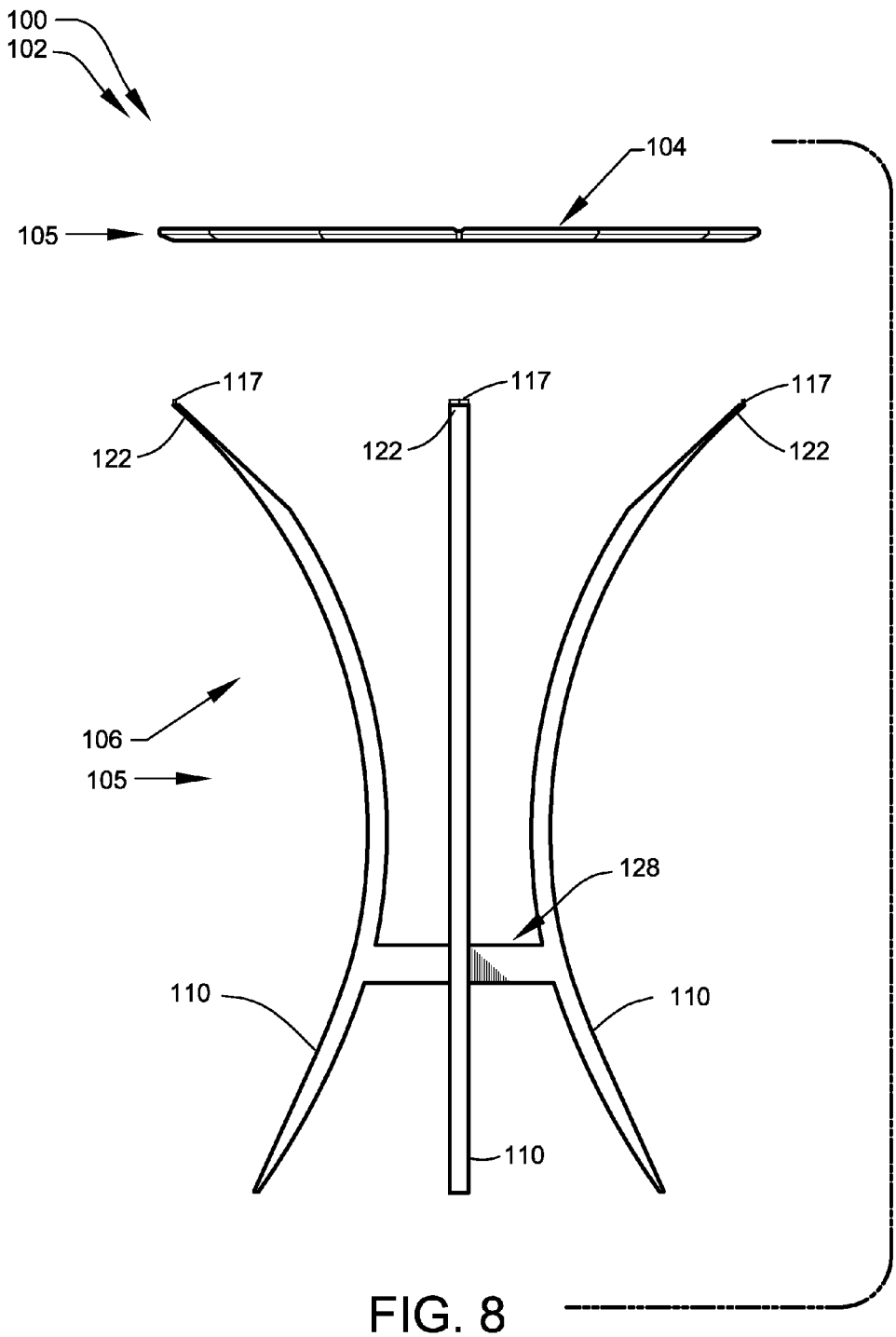
FIG. 8 is an exploded side view of the modular stackable table of FIG. 1 with the top removed.

FIG. 3 is a front view of the assembled modular stackable table 102 of FIG. 1. It is noted that the rear view, right-side view, and left-side are symmetrically identical to the front view of FIG. 3. FIG. 4 is a top view of a preferred table top 104 used to assemble modular stackable table 102 of FIG. 1. FIG. 5 is a bottom view of modular stackable table 102 of FIG. 1. FIG. 6 is a sectional view through the section 6-6 of FIG. 3. FIG. 7 is a detail view of the detail 7 of FIG. 3 (magnified for clarity).

Referring to FIG. 3 through FIG. 7, each table top 104 preferably comprises a generally planar member having an upper surface 108 and an opposing lower surface 112, as shown. Lower surface 112 preferably comprises at least one receiver 114 designed to receive at least one engaging portion 116 of table bases 106 (see FIG. 7).

Each table base 106 preferably comprises at least three support legs 110 with the most preferred embodiments of the system comprising four support legs 110, as shown. Support legs 110 are preferably spaced equidistantly about vertical central axis 113, as shown.

Together support legs 110 generally define a lower table-base portion 118 and upper table-base portion 120, as shown. All lower table-base portions 118 are preferably configured to rest stably on a floor or other supportive surface 115, as shown. Each support leg 110 preferably rises to an upper termination 122 containing the above-noted engaging portion 116. Each support leg 110 preferably projects generally upwardly and outwardly as it rises to approach a respective upper termination 122, as shown.

In one preferred embodiment of the system, each receiver 114 comprises a recessed slot 111 formed within lower surface 112, as shown (see FIG. 7). In such a preferred embodiment of the system, each engaging portion 116 preferably comprises a rigid projecting member 117 preferably designed to fit within the recessed slot forming receiver 114. When coupled, engaging portions 116 and receivers 114 together form a frictional retainer 124 structured and arranged to assist frictional retention of engaging portion 116 within a receiver 114. Furthermore, the preferred physical geometries of table tops 104 and table bases 106 are together structured and arranged to provide increasing levels of frictional force between receivers 114 and engaging portions 116 as weight supported by table top 104 is increased. FIG. 7 illustrates, diagrammatically, the preferred generally-horizontal outward force component generated by the preferred outwardly curving shape of support legs 110 and frictional resistance to such force provided by the capture of the engaging portions 116 of the upper legs within the lower receivers 114 formed within the tops. This preferred frictional capture arrangement, collectively identified herein as pressure-modulated force increaser 126, preferably permits quick "tool-less" assembly and disassembly of table components, while preferably maintaining positive retention of parts while in use (at least embodying herein wherein such at least one frictional retainer comprises at least on pressure-modulated force increaser structured and arranged to provide increasing levels of friction force between such at least one receiver and such at least one engaging portion as weight supported by a respective one of such table top is increased).

Table bases 106 preferably comprise a preferred table-base height A of about 110 centimeters, as measured vertically between lower table-base portion 118 and the upper table-base portion 120. Each support leg 110 forming lower table-base portion 118 preferably follows a continuous outward curve, as shown. The grouping of legs forming lower table-base portion 118 preferably comprise a maximum contact width B, as measured at supportive surface 115, of about 60 centimeters.

Preferably, support legs 110 forming lower table-base portion 118 are rigidly coupled by at least one leg connector 128 structured and arranged to rigidly interconnect such at least three support legs, as shown. Leg connector 128 is preferably located at or below midpoint C of the support legs 110, as shown. Midpoint C preferably falls at about one half of table-base height A (about 55 centimeters). The narrowest portion of table base 106 preferably coincides approximately with the table-base height A, as shown, splaying out slightly for balance as the legs approach the floor. The preferred location of the cross-bar leg connector 128 at or below table-base height A is preferably designed to assist in shifting the center of balance of the overall assembly nearer supportive surface 115, thus promoting stability within the overall table structure.

Support legs 110 of table bases 106 are preferably constructed from metallic members, preferably steel member, preferably one inch by one inch by 16-gauge cold-rolled tubular steel. The cross-bar leg connector 128 is preferably constructed from one inch by two inch by 16-gauge cold rolled tubular steel crossbars. The cross-bar leg connector 128 and support legs 110 are preferably assembled by thermal welding. To protect supportive surfaces 115 from damage, one half inch by one inch rectangular plastic cups are applied to the base of the legs contacting supportive surfaces 115.

Table bases 106 are preferably comprise at least one durable protective finish. In one preferred embodiment of the system, table bases 106 are preferably finished in powder coat (preferably comprising a thermoplastic or thermoset polymer). Surfaces receiving powder coat are preferably prepared by light media blasting. Those of ordinary skill in the art will appreciate that powder coats are available in many hundreds of standard colors, gloss levels, and textures.

Table tops 104 are preferably constructed from a rigid material, preferably Medium-Density Fiberboard (MDF) having a preferred thickness of about five-eighths inch. When patterning is applied to upper surface 108, or intricate detailing is preferred, table tops 104 are preferably cut using computer numerical control (CNC) machine tool. For example, when upper surface 108 comprises the depicted texture-providing grooves 130 (recessed below the upper surface, as shown), such grooves 130 are preferably cut using computer a numerical control (CNC) router or similar tool.

In one preferred embodiment of the system, table tops 104 are preferably finished in powder coat applied over a primer base coat. Upon reading this specification, those with ordinary skill in the art will now appreciate that, under appropriate circumstances, considering such issues as design preference, user preferences, marketing preferences, cost, environmental requirements, available materials, technological advances, etc., other finish/material arrangements such as, for example, molded plastics, metals, composites of multiple materials, etc., may suffice.

In one preferred embodiment of the system, table tops 104 and table base 106 are preferably configured to support, in an operable position, at least one shaft of at least one umbrella 132 (indicated diagrammatically by the dashed-line depiction of FIG. 1). In such a preferred embodiment of the present system, table top 104 and leg connector 128 are preferably modified to comprise apertures 134 configured to receive the shaft of umbrella 132. Apertures 134 are preferably located coaxially with central axis 113.

Figure 9:
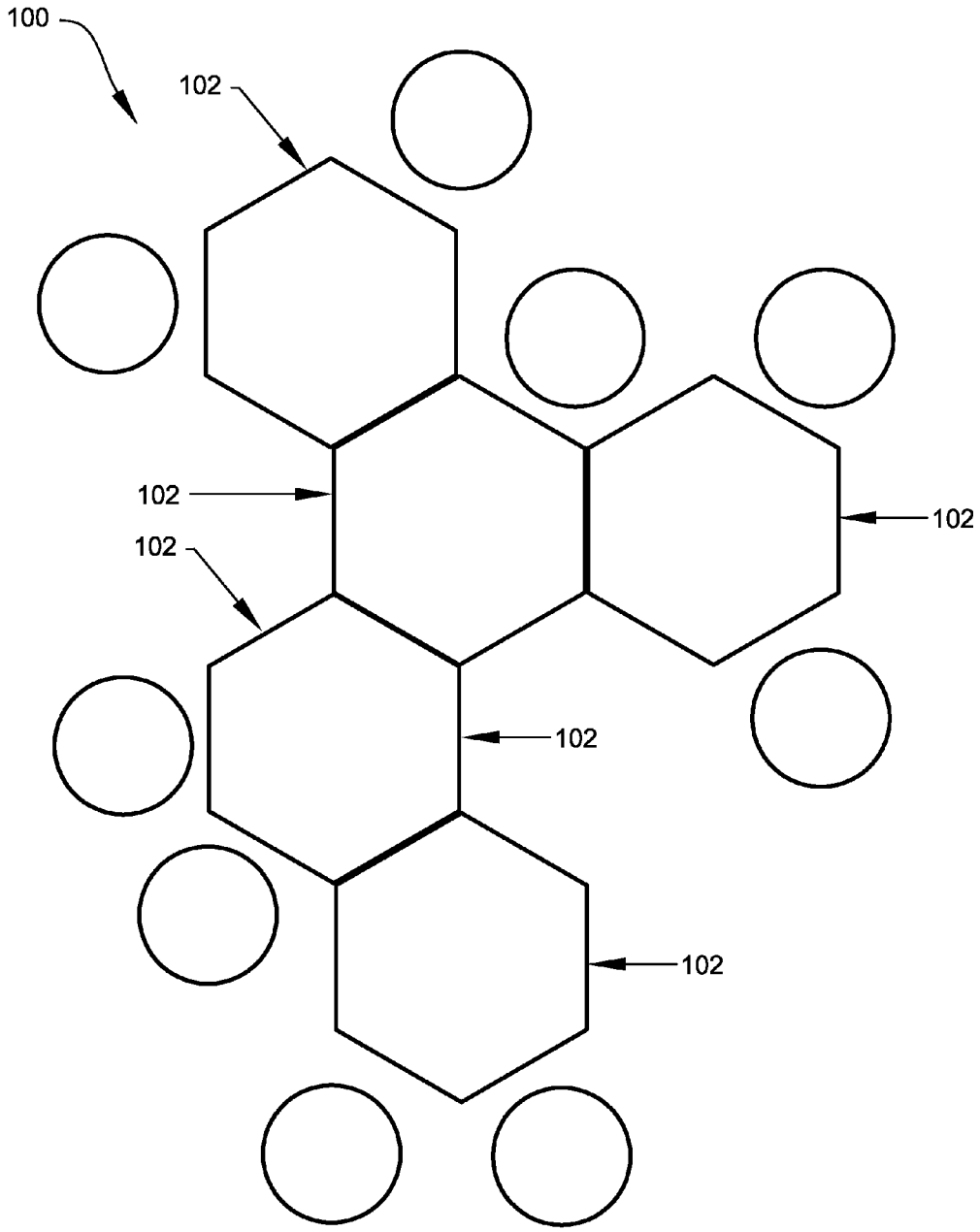
FIG. 9 is a plan view of a "ganged" arrangement of modular stackable tables, comprising an alternate preferred top geometry, according to an alternate preferred embodiment of the present invention.

FIG. 9 is a plan view of a "ganged" arrangement of modular stackable tables 102, comprising an alternate preferred tabletop geometry (hexagons), according to an alternate preferred embodiment of the present invention. It is preferably possible, with some of the preferred tabletop configurations, to create a number of different "ganged" configurations, as shown.

FIG. 10 is a side view of the previously-described "nesting-stacked" arrangement of modular stackable table bases 106, according to preferred embodiments of the present invention. When not in use, table bases 106 may be nesting-stacked or spirally nesting-stacked, as shown. Each stack preferably comprise up to about 8 table bases 106. Stacking table bases offers significant benefits in terms of protecting the product, minimizing handling costs, and minimizing storage space requirements.

Figure 11:
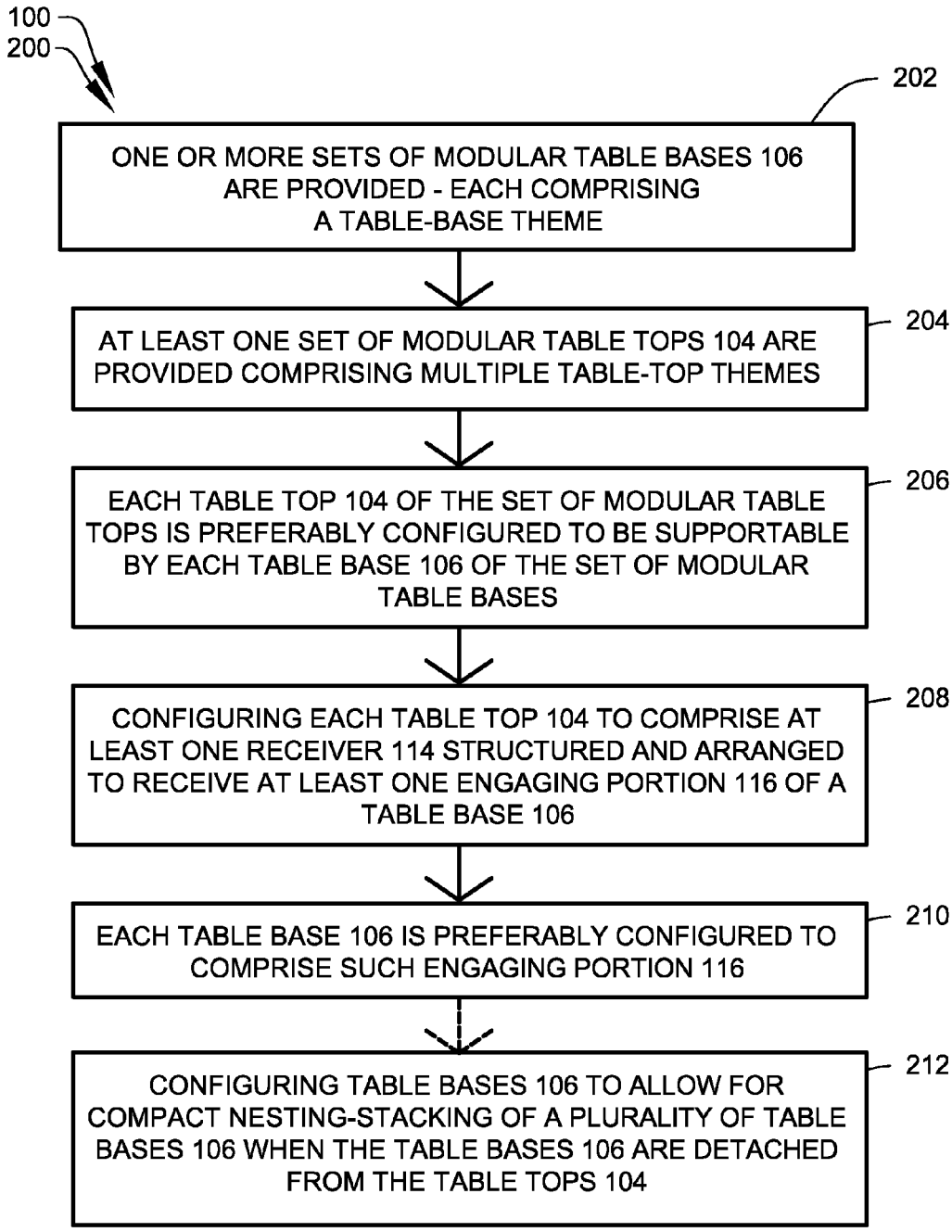
FIG. 11 is a flow diagram, illustrating a preferred method of generating distinctly themed tables from modular table components, according to preferred methods and embodiments of the present invention.

FIG. 11 is a flow diagram, illustrating preferred method 200 of generating such distinctly themed tables 102 from a small set of modular table components, according to preferred methods and embodiments of the present invention. In initial preferred step 202 of method 200, at least one set of modular table bases 106 are provided. As previously described, such set of modular table bases 106 preferably comprise multiple table-base themes (that is, colors, textures, etc.). Next, as indicated in preferred step 204, at least one set of modular table tops 104 are provided comprising multiple table-top themes. In subsequent preferred step 206, each table top 104 of the set of modular table tops is preferably configured to be supportable by each table base 106 of the set of modular table bases. The system is further enhanced in preferred step 208 by preferably configuring each table top 104 to comprise at least one receiver 114 structured and arranged to receive at least one engaging portion 116 of a table base 106. Thus, as indicated in preferred step 210, each table base 106 is preferably configured to comprise such engaging portion 116. As previously described, each receiver 114, when combined with at least one engaging portion 116, together comprise frictional retainer 124, which preferably assists the previously-described frictional retention of engaging portion 116 with receiver 114.

As previously noted, the preferred generally-horizontal outward force generated by the outwardly curving support legs 110 and frictional resistance to such force provided by the capture of engaging portions 116 within the lower receivers 114 collectively forms pressure-modulated force increaser 126, which preferably functions provide increasing levels of friction force between the receiver and the engaging portion as weight supported by table top 104 is increased. In this preferred manner, at least one distinct set of tables 102, comprising a distinct table theme, may be developed by combining table tops 104 selected from the set of modular table tops with table bases 106 selected from the set of modular table bases.

In addition, method 200 further comprises the additional preferred step 212 of configuring table bases 106 to allow for compact nesting-stacking of a plurality of table bases 106 when the table bases 106 are detached from the table tops 104, as generally depicted in FIG. 10.

Although applicant has described applicant's preferred embodiments of this invention, it will be understood that the broadest scope of this invention includes modifications such as diverse shapes, sizes, and materials. Such scope is limited only by the below claims as read in connection with the above specification. Further, many other advantages of applicant's invention will be apparent to those skilled in the art from the above descriptions and the below claims.

What is claimed is:

1. A modular table system, relating to modular table components capable of forming distinct sets of themed tables, said modular table system comprising:

a) at least one first set of table bases, each said table base of said at least one first set of table bases comprising at least one first common base feature;

b) at least one first set of table tops, each said table top of said at least one first set of table tops comprising at least one first common top feature; and c) at least one second set of table tops, each said table top of said at least one second set of table tops comprising at least one second common top feature differing from said at least one first common top feature;

d) wherein each table top of said at least one first set of table tops and said at least one second set of table tops is configured to be supportable by each said table base of said at least one first set of table bases;

e) wherein each said table top of said at least one first set of table tops and each said table top of said at least one second set of table tops comprise at least one receiver structured and arranged to receive at least one engaging portion of at least one said table base of said at least one first set of table bases;

f) wherein each said table base of said at least one first set of table bases comprises such at least one engaging portion structured and arranged to engage said at least one receiver of each said table top of either one of said at least one first set of table tops and said at least one second set of table tops;

g) wherein each said at least one receiver and said at least one engaging portion together comprise at least one frictional retainer structured and arranged to assist frictional retention of said at least one engaging portion with said at least one receiver;

h) wherein said at least one frictional retainer comprises at least one pressure-modulated force increaser structured and arranged to provide increasing levels of friction force between said at least one receiver and said at least one engaging portion as weight supported by a respective one of said table top is increased; and i) wherein, when detached from said table top, each said table base of said at least one first set of table bases is nestable-stackable with each other said table base of said at least one first set of table bases.

2. The modular table system, according to claim 1, further comprising:

a) at least one second set of table bases, each said table base of said at least one second set of table bases comprising at least one second common base feature differing from said at least one first common base feature;

b) wherein each table top of said at least one first set of table tops and said at least one second set of table tops is configured to be supportable by each said table base of either one of said at least one first set of table bases and each said table base of said at least one second set of table bases;

c) wherein each said table top of said at least one first set of table tops and each said table top of said at least one second set of table tops comprise at least one receiver structured and arranged to receive at least one engaging portion of at least one said table base of either one of said at least one first set of table bases and said at least one second set of table bases;

d) wherein each said table base of said at least one first set of table bases and each said table base of said at least one second set of table bases comprise such at least one engaging portion structured and arranged to engage said at least one receiver of each said table top of either one of said at least one first set of table tops and said at least one second set of table tops; and e) wherein, when detached from said table top, each said table base of said at least one first set of table bases allow nesting-stacking with each said table base of either said at least one first set of table bases and said at least one second set of table bases.

3. The modular table system, according to claim 2, wherein each said table base comprises:

a) at least three support legs that together comprise at least one lower table-base portion and at least one upper table-base portion; and b) at least one table-base height comprising said at least one lower table-base portion and said at least one upper table-base portion;

c) wherein said at least one lower table-base portion is configured to rest stably on at least one supportive surface; and d) wherein said at least one upper table-base portion comprises said at least one engaging portion.

4. The modular table system, according to claim 3, further comprising:

a) at least one leg connector structured and arranged to rigidly interconnect said at least three support legs;

b) wherein said at least one leg connector is located at or below a midpoint height of said table base equaling about one half of such at least one table-base height.

5. The modular table system, according to claim 4, wherein:

a) within said at least one upper table-base portion, each said at least three support legs comprise at least one upper termination; and b) each said at least three support legs project generally upwardly and outwardly as said at least three support legs approach their respective said at least one upper terminations.

6. The modular table system, according to claim 5, wherein each one of said at least three support legs follows a continuous curve.

7. The modular table system, according to claim 5, wherein each respective said at least one upper termination of said at least three support legs comprise a respective said at least one engaging portion.

8. The modular table system, according to claim 5, further comprising four of said at least three support legs spaced equidistantly about a vertical central axis.

9. The modular table system, according to claim 5, wherein:

a) said table top is constructed substantially of at least one medium density fiberboard; and b) each said table base is constructed substantially of at least one rigid metallic material.

10. The modular table system, according to claim 9, wherein said at least one rigid metallic material comprises substantially steel.

11. The modular table system, according to claim 5, wherein:

a) said table-base height comprises a maximum height of about one-hundred-ten centimeters; and b) said table top comprises a maximum width of about one-hundred centimeters.

12. The modular table system, according to claim 5, wherein said at least one lower table-base portion comprises a maximum contact width of about sixty centimeters.

13. The modular table system, according to claim 5, wherein at least one said table top and at least one said table base are configured to support, in an operable position, at least one shaft of at least one umbrella.

14. The modular table system, according to claim 5, wherein:

a) each said table top comprises at least one upper surface and at least one lower surface;

b) said at least one lower surface comprises said at least one receiver; and c) said at least one upper surface comprises at least one texture-providing groove recessed below said at least one upper surface.

15. A method relating to forming distinct sets of themed tables from modular table components, said method comprising the steps of:

a) providing at least one set of modular table bases comprising multiple table-base themes;

b) providing at least one set of modular table tops comprising multiple table-top themes;

c) configuring each table top of such at least one set of modular table tops to be supportable by each such table base of such at least one set of modular table bases;

d) configuring each table top of such at least one set of modular table tops to comprise at least one receiver structured and arranged to receive at least one engaging portion of at least one such table base; and e) configuring each such table base of such at least one set of modular table bases to comprise such at least one engaging portion structured and arranged to engage such at least one receiver of each such table top;

f) wherein each such at least one receiver and such at least one engaging portion together comprise at least one frictional retainer structured and arranged to assist frictional retention of such at least one engaging portion with such at least one receiver;

g) wherein said at least one frictional retainer comprises at least on pressure-modulated force increaser structured and arranged to provide increasing levels of friction force between said at least one receiver and said at least one engaging portion as weight supported by a respective one of said table top is increased; and h) wherein at least one distinct set of tables, comprising a distinct table theme, may be developed by combining such table tops selected from such at least one set of modular table tops with such at least one table bases selected from such at least one set of modular table bases.

16. The method, according to claim 15, further comprising the steps of configuring such table bases to allow for compact nesting-stacking of a plurality of such table bases when such table bases are detached from such table tops.

17. A modular table system, relating to modular table components capable of forming distinct sets of themed tables, said modular table system comprising:

a) at least one set of modular table bases comprising multiple table-base themes; and b) at least one set of modular table tops comprising multiple table-top themes;

c) wherein each table top of such at least one set of modular table tops is configured to be supportable by each such table base of such at least one set of modular table bases;

d) wherein each said table base comprises i) at least three support legs that together comprise at least one lower table-base portion and at least one upper table-base portion, ii) at least one table-base height extending substantially vertically between said at least one lower table-base portion and said at least one upper table-base portion, and iii) at least one leg connector structured and arranged to rigidly interconnect said at least three support legs;

e) wherein said at least one leg connector is located at or below a midpoint of equaling one half of such at least one table-base height;

f) wherein each one of said at least three support legs follow a continuous curve; and g) wherein at least one distinct set of tables, comprising a distinct table theme, may be developed by combining such table tops selected from such at least one set of modular table tops with such at least one table bases selected from such at least one set of modular table bases.

18. The modular table system, according to claim 17, wherein:

a) said table-base height comprises a maximum height of about one-hundred-ten centimeters; and b) said table top comprises a maximum width of about one-hundred centimeters.

19. The modular table system, according to claim 18, further comprising exactly four of said at least three support legs spaced equidistantly about a vertical central axis.

20. The modular table system according to claim 19 wherein:

a) said table top is constructed substantially of at least one medium density fiberboard; and b) each said table base is constructed substantially of at least one rigid metallic material.

21. The modular table system, according to claim 20, wherein said at least one rigid metallic material comprises substantially steel.

* * * * *